US008655489B2

(12) United States Patent
Horiuchi et al.

(10) Patent No.: US 8,655,489 B2
(45) Date of Patent: Feb. 18, 2014

(54) AIR-CONDITIONING CONTROLLER

(75) Inventors: Kaya Horiuchi, Sakai (JP); Hisashi Sumida, Sakai (JP); Takashi Hasegawa, Sakai (JP); Kiyoshi Shima, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 808 days.

(21) Appl. No.: 12/596,848

(22) PCT Filed: Apr. 22, 2008

(86) PCT No.: PCT/JP2008/057714
§ 371 (c)(1),
(2), (4) Date: Oct. 21, 2009

(87) PCT Pub. No.: WO2008/139846
PCT Pub. Date: Nov. 20, 2008

(65) Prior Publication Data

US 2010/0121492 A1 May 13, 2010

(30) Foreign Application Priority Data

Apr. 24, 2007 (JP) ..... 2007-114281

(51) Int. Cl.
*G01M 1/38* (2006.01)

(52) U.S. Cl.
USPC ..... 700/276

(58) Field of Classification Search
USPC ..... 700/276–278, 299, 300
See application file for complete search history.

(56) References Cited

U.S. PATENT DOCUMENTS

| | | | | |
|---|---|---|---|---|
| 5,505,378 | A * | 4/1996 | Park | 236/49.3 |
| 6,283,380 | B1 * | 9/2001 | Nakanishi et al. | 236/49.3 |
| 6,334,317 | B1 * | 1/2002 | Bougauchi et al. | 62/127 |
| 6,739,145 | B2 * | 5/2004 | Bhatnagar | 62/127 |
| 6,978,627 | B2 * | 12/2005 | Masui et al. | 62/127 |
| 2004/0117084 | A1 * | 6/2004 | Mercier et al. | 701/36 |

FOREIGN PATENT DOCUMENTS

| | | | |
|---|---|---|---|
| JP | 2798065 | B2 | 7/1998 |
| JP | 10-339498 | A | 12/1998 |
| JP | 2000-55447 | A | 2/2000 |
| JP | 2002-5497 | A | 1/2002 |
| JP | 2002-22250 | A | 1/2002 |
| JP | 2007-15527 | A | 6/2007 |
| KR | 2005-0063868 | A | 6/2005 |
| KR | 2006-0127348 | A | 12/2006 |

OTHER PUBLICATIONS

Office Action of corresponding Korean Application No. 2009-7023316 dated Jul. 7, 2011.

* cited by examiner

*Primary Examiner* — Sean P. Shechtman
*Assistant Examiner* — Chad Rapp
(74) *Attorney, Agent, or Firm* — Global IP Counselors

(57) ABSTRACT

An air-conditioning controller is configured to receive an operation input for an air-conditioning apparatus capable of being set to a plurality of airflow direction settings. The air-conditioning controller includes a switching button, a determination unit and a display unit. The switching button is for switching between the airflow direction settings. The determination unit is configured to determine a currently selected airflow direction setting based on an operation input inputted via the switching button. The display unit is configured to simultaneously display an image and a character corresponding to the airflow direction setting determined to be currently selected by the determination unit.

11 Claims, 9 Drawing Sheets

AIR-CONDITIONING CONTROLLER

CROSS-REFERENCE TO RELATED APPLICATIONS

This U.S. National stage application claims priority under 35 U.S.C. §119(a) to Japanese Patent Application No. 2007-114281, filed in Japan on Apr. 24, 2007, the entire contents of which are hereby incorporated herein by reference.

TECHNICAL FIELD

The present invention relates to an air-conditioning controller for receiving operation input to an air-conditioning apparatus capable of a plurality of airflow direction settings.

BACKGROUND ART

In conventional practice, air-conditioning controllers of air-conditioning apparatuses are sometimes provided with liquid crystal screens or other display units. In many cases, currently selected air-conditioning settings are displayed on the display units. When a user changes the air-conditioning settings by operating an operation button or the like provided to the air-conditioning controller, the screen on the display unit also changes so as to correspond to the change.

Such air-conditioning controllers include those in which the currently selected airflow direction setting is displayed by an image on the display unit Japanese Patent Publication No. 2798065, for example).

SUMMARY OF THE INVENTION

Technical Problem

However, with an air-conditioning controller such as the one in Japanese Patent Publication No. 2798065 in which the currently selected airflow setting is displayed by an image alone, although it is comparatively easy for the user to approximately understand by sense the currently selected airflow setting, it is not necessarily easy for the user to accurately understand the setting.

An object of the present invention is to improve the operability of an air-conditioning controller with respect to the airflow direction setting of an air-conditioning apparatus.

Solution to Problem

An air-conditioning controller according to a first aspect of the present invention comprises a switching button, a determination unit, and a display unit; and receives an operation input for operating an air-conditioning apparatus capable of being set to a plurality of airflow direction settings. The switching button is a button for switching between the airflow direction settings. The determination unit determines a currently selected airflow direction setting on the basis of the operation input inputted via the switching button. The display unit simultaneously displays an image and a character corresponding to the airflow direction setting determined to be currently selected by the determination unit.

With this air-conditioning controller, a user can, while pressing the switching button, choose their own desired airflow direction setting from among a plurality of airflow direction settings that can be set in the air-conditioning apparatus. At this time, an image and a character corresponding to the airflow direction setting currently selected by the user are simultaneously displayed on the display unit of the air-conditioning controller. Therefore, the user can perceptively recognize the currently selected airflow direction setting by the image on the display unit, and can therefore ultimately easily choose their own desired airflow direction setting from among the airflow direction settings. It is also easy to accurately recognize the user's own selected airflow direction setting by the character on the display unit. As a result, for example, when the user has found a favorable airflow direction setting or the like, the airflow direction setting can be accurately re-selected, or in cases in which the airflow direction setting has been changed by another user or by an abnormality, the change can easily be perceived. The airflow direction settings are also expressed in characters, whereby the user can easily show the currently selected airflow direction setting to others. For example, in cases in which the user has contacted a contact center during the occurrence of an abnormality, the contact center staff can easily be informed of whichever airflow direction setting has been currently selected. Thus, with this air-conditioning controller, the operability with respect to the airflow direction settings of the air-conditioning apparatus is improved.

The air-conditioning controller according to a second aspect of the present invention is the air-conditioning controller according to the first aspect, wherein the display unit simultaneously displays the image and the character in a one-to-one correspondence with the airflow direction setting determined to be currently selected by the determination unit.

In this air-conditioning controller, the image and the character corresponding in a one-to-one ratio with the airflow direction setting currently selected by the user are simultaneously displayed on the display unit. With this air-conditioning controller, the operability with respect to the airflow direction settings of the air-conditioning apparatus is thereby further improved.

The air-conditioning controller according to a third aspect of the present invention is the air-conditioning controller according to the first or second aspect, wherein the switching button is a combination of a first directional button corresponding to a first direction and a second directional button corresponding to a second direction. The second direction is the opposite direction of the first direction.

This air-conditioning controller is equipped with two directional buttons (a first directional button and a second directional button) indicating mutually opposite directions. The user can thus more easily switch the airflow direction setting by using the two directional buttons.

The air-conditioning controller according to a fourth aspect of the present invention is the air-conditioning controller according to the third aspect, wherein the currently selected airflow direction setting switches in a first sequence among the airflow direction settings every time the first directional button is pressed. The currently selected airflow direction setting switches in a second sequence opposite of the first sequence among the airflow direction settings every time the second directional button is pressed.

With this air-conditioning controller, the sequence whereby the airflow direction setting switches is opposite between cases of pressing the first directional button and cases of pressing the second directional button. Specifically, the air-conditioning apparatus has four airflow direction settings: "swing", "up", "mid", and "down" for example. In cases in which the airflow direction setting switches from "swing" to "up", from "up" to "mid", and from "mid" to "down" every time the first directional button is pressed, the airflow direction setting will switch from "down" to "mid", from "mid" to "up", and from "up" to "swing" every time the second directional button is pressed. Unlike the fourth aspect of the present invention, in an air-conditioning controller having only one switching button for switching the airflow direction setting, the airflow direction setting can only be switched in one direction. As a result, in cases in which the user has gone past the desired airflow direction setting by excessively pressing the switching button, the button must be pressed several times again in order to return to the desired airflow direction setting. With the air-conditioning controller according to the fourth aspect of the present invention, however, since two directional buttons are provided, the airflow direction setting can be switched in two directions, and if the user presses one directional button too much, the user can easily return to the desired airflow direction setting by pressing the other directional button. Thus, with the air-conditioning controller according to the fourth aspect, the airflow direction setting can be adjusted even more easily.

The air-conditioning controller according to a fifth aspect of the present invention is the air-conditioning controller according to the fourth aspect, wherein the first sequence is a sequence whereby the airflow direction settings are arranged from smallest to greatest in terms of the first directional component of air blown out from the air-conditioning apparatus.

With this air-conditioning controller, the user can orient the air from the air-conditioning apparatus in the first direction by pressing the first directional button. With this air-conditioning controller, the user can thereby more perceptively select the airflow direction setting.

The air-conditioning controller according to a sixth aspect of the present invention is the air-conditioning controller according to any of the third through fifth aspects, wherein the first direction is an upward direction.

This air-conditioning controller is equipped with an up directional button and a down directional button. The user can thereby more easily switch the airflow direction setting by using the up directional button and the down directional button.

The air-conditioning controller according to a seventh aspect of the present invention is the air-conditioning controller according to any of the first through sixth aspects, wherein the character corresponding to the currently selected airflow direction setting includes a numeral.

With this air-conditioning controller, the currently selected airflow direction setting can be displayed in a straightforward manner by a numeral. This aspect is particularly useful in the case of a small display area.

The air-conditioning controller according to an eighth aspect of the present invention is the air-conditioning controller according to any of the first through seventh aspects, wherein the image corresponding to the currently selected airflow direction setting include a first image and a second image. The first image schematically depicts the air-conditioning apparatus. The second image schematically depicts the air blown out from the air-conditioning apparatus.

With this air-conditioning controller, the currently selected airflow direction setting is expressed by a combination of a schematic image (first image) of the air-conditioning apparatus and a schematic image (second image) of the air blown out from the air-conditioning apparatus. The user can thereby more perceptively recognize the currently selected airflow direction setting.

The air-conditioning controller according to a ninth aspect of the present invention is the air-conditioning controller according to the eighth aspect, wherein the first images included in the images corresponding to the respective airflow direction settings are mutually shared. The second images included in the images corresponding to the respective airflow direction settings are mutually different.

With this air-conditioning controller, when the airflow direction setting is switched, the schematic image of air blown out from the air-conditioning apparatus is changed while the schematic image of the air-conditioning apparatus displayed on the display unit remains the same. The user can thereby more perceptively recognize the currently selected airflow direction setting.

The air-conditioning controller according to a tenth aspect of the present invention is the air-conditioning controller according to the ninth aspect, wherein a swing setting is included in the airflow direction settings. The second image included in the image corresponding to the swing setting is an image schematically and simultaneously depicting air blown out in various directions from the air-conditioning apparatus.

With a conventional air-conditioning controller, it is common for the swing setting to be expressed by a moving image in which the schematic image of air blown out in various directions switches in sequence. In this case, it is difficult for the user to immediately understand that the swing setting is currently selected. With the air-conditioning controller according to the tenth aspect of the present invention, however, the image corresponding to the swing setting is a combination of a schematic image (first images) of the air-conditioning apparatus and an image (second image) simultaneously depicting schematic images of air blown out in various directions. With the air-conditioning controller according to the tenth aspect, the user can thereby immediately understand that the swing setting is currently selected.

Advantageous Effects of Invention

An image and a character corresponding to the airflow direction setting currently selected by the user are simultaneously displayed on the display unit of the air-conditioning controller according to the first aspect. Therefore, the user can perceptively recognize the currently selected airflow direction setting by the image on the display unit, and can therefore ultimately easily choose their own desired airflow direction setting from among the airflow direction settings. It is also easy to accurately recognize the user's own selected airflow direction setting by the character on the display unit. As a result, for example, when the user has found a favorable airflow direction setting or the like, the airflow direction setting can be accurately re-selected, or in cases in which the airflow direction setting has been changed by another user or by an abnormality, the change can easily be perceived. The airflow direction settings are also expressed in characters, whereby the user can easily show the currently selected airflow direction setting to others. For example, in cases in which the user has contacted a contact center during the occurrence of an abnormality, the contact center staff can easily be informed of whichever airflow direction setting has been currently selected. Thus, with this air-conditioning controller, the operability with respect to the airflow direction settings of the air-conditioning apparatus is improved.

With the air-conditioning controller according to the second aspect, the operability with respect to the airflow direction settings of the air-conditioning apparatus is further improved.

With the air-conditioning controller according to the third aspect, the user can more easily switch the airflow direction setting by using the two directional buttons.

With the air-conditioning controller according to the fourth aspect, the airflow direction setting can be adjusted even more easily.

With the air-conditioning controller according to the fifth aspect, the user can more perceptively select the airflow direction setting.

With the air-conditioning controller according to the sixth aspect, the user can more easily switch the airflow direction setting by using the up directional button and the down directional button.

With the air-conditioning controller according to the seventh aspect, the currently selected airflow direction setting can be displayed in a straightforward manner by a numeral. This aspect is particularly useful in the case of a small display area.

With the air-conditioning controller according to the eighth aspect, the user can more perceptively recognize the currently selected airflow direction setting.

With the air-conditioning controller according to the ninth aspect, the user can more perceptively recognize the currently selected airflow direction setting.

With the air-conditioning controller according to the tenth aspect, the user can immediately understand that the swing setting is currently selected.

BRIEF DESCRIPTION OF THE DRAWINGS

FIG. 7(*b*) is a drawing showing an airflow direction setting screen when "position 3" has been selected.

FIG. 7(*c*) is a drawing showing an airflow direction setting screen when "position 2" has been selected.

FIG. 7(*d*) is a drawing showing an airflow direction setting screen when "position 1" has been selected.

FIG. 7(*e*) is a drawing showing an airflow direction setting screen when "position 0" has been selected.

FIG. 7(*f*) is a drawing showing an airflow direction setting screen when "swing" has been selected.

FIG. 8(*b*) is a drawing showing an airflow direction setting screen according to Modification (D) when "position 3" has been selected.

FIG. 8(*c*) is a drawing showing an airflow direction setting screen according to Modification (D) when "position 2" has been selected.

FIG. 8(*d*) is a drawing showing an airflow direction setting screen according to Modification (D) when "position 1" has been selected.

FIG. 8(*e*) is a drawing showing an airflow direction setting screen according to Modification (D) when "position 0" has been selected.

FIG. 8(*f*) is a drawing showing an airflow direction setting screen according to Modification (D) when "swing" has been selected.

FIG. 9(*b*) is a drawing showing an airflow direction setting screen according to Modification (E) when "position 3" has been selected.

FIG. 9(*c*) is a drawing showing an airflow direction setting screen according to Modification (E) when "position 2" has been selected.

FIG. 9(*d*) is a drawing showing an airflow direction setting screen according to Modification (E) when "position 1" has been selected.

FIG. 9(*e*) is a drawing showing an airflow direction setting screen according to Modification (E) when "position 0" has been selected.

FIG. 9(*f*) is a drawing showing an airflow direction setting screen according to Modification (E) when "swing" has been selected.

DETAILED DESCRIPTION OF THE INVENTION

The following is a description, made with reference to the drawings, of an air-conditioning controller 1 for operating an air-conditioning apparatus 100 according to an embodiment of the present invention.

<Overall General Configuration>

Figure 1:
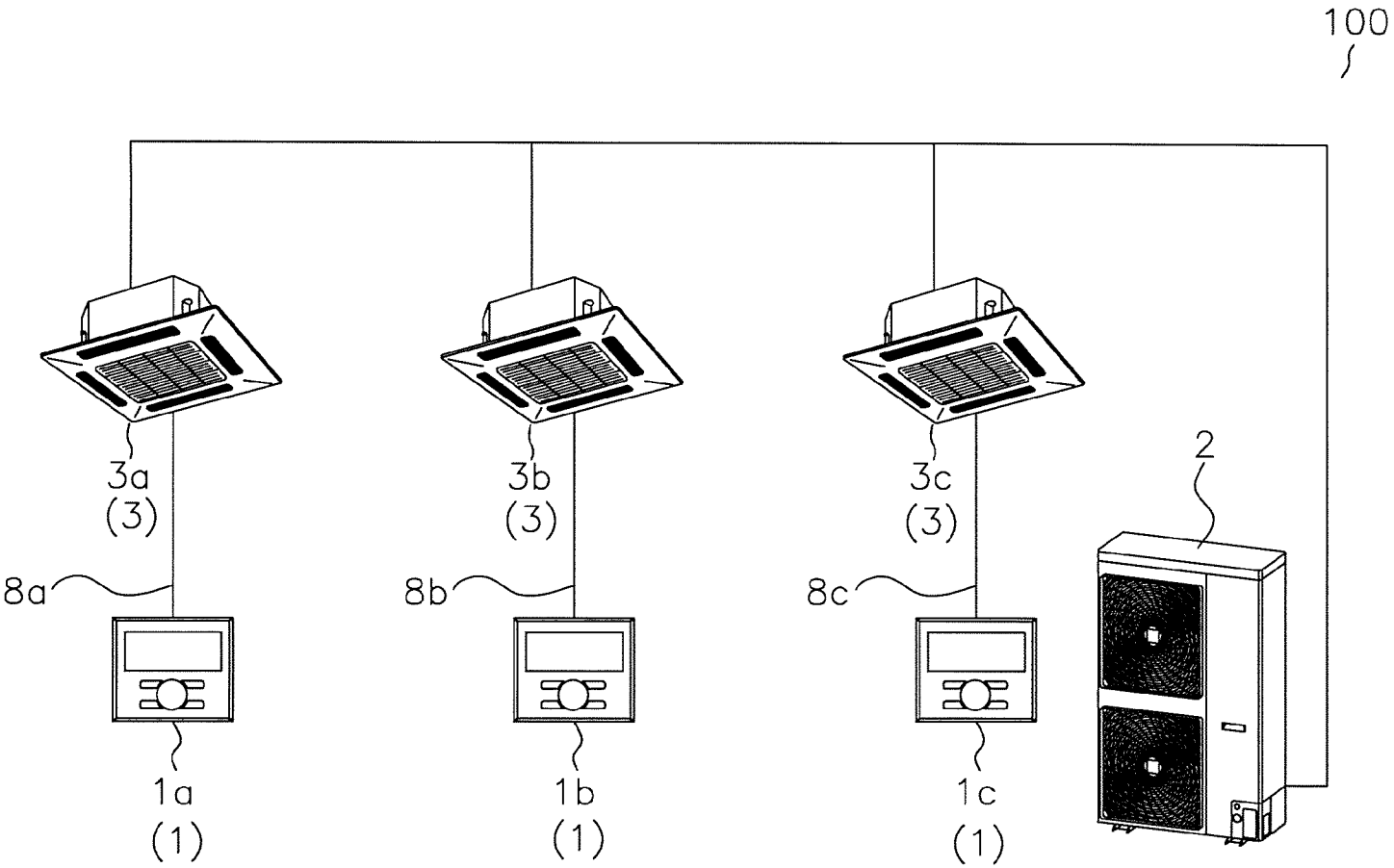
FIG. 1 is a general configuration drawing of an air-conditioning apparatus for which air-conditioning controllers according to an embodiment of the present invention are used.
Figure 2:
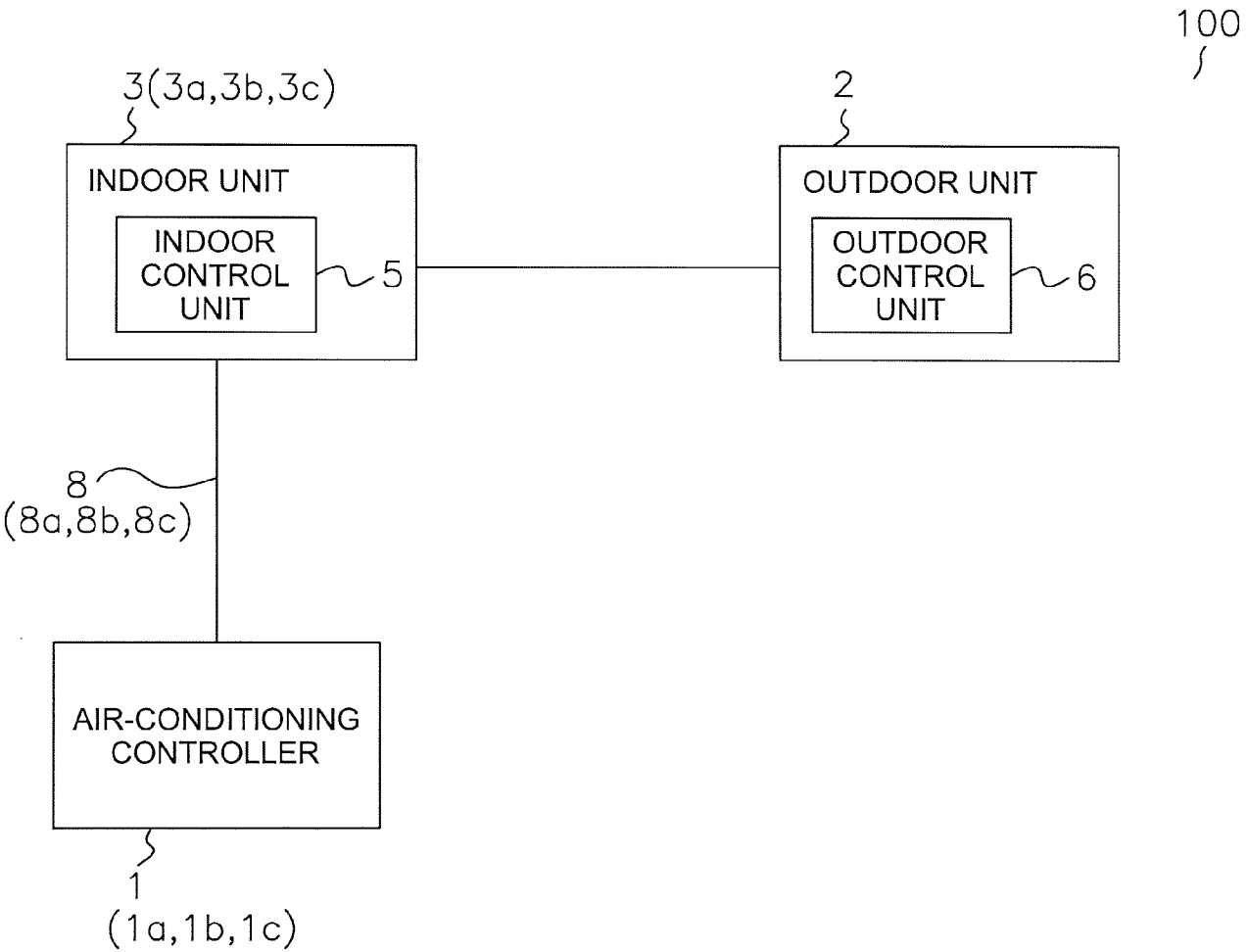
FIG. 2 is a block configuration diagram of the air-conditioning apparatus and the air-conditioning controller.

FIG. 1 shows a general configuration drawing of the air-conditioning apparatus 100 and the air-conditioning controllers 1. Each of the air-conditioning controllers 1 receives operation input to the air-conditioning apparatus 100 from a user and controls the air-conditioning apparatus 100 in accordance with the operation input. FIG. 2 shows a function block diagram showing the relationship between the air-conditioning apparatus 100 and the air-conditioning controller 1.

The air-conditioning apparatus 100 includes an outdoor unit 2, and a plurality of indoor units 3*a*, 3*b*, 3*c* connected to the outdoor unit 2 via refrigerant tubes and communication wires. The indoor units 3*a*, 3*b*, 3*c* are installed indoors so as to be suspended from a ceiling. An air-conditioning controller 1*a* mainly for performing the operative settings of the indoor unit 3*a* is connected to the indoor unit 3*a* via a communication wire 8*a*. Similarly, an air-conditioning controller 1*b* mainly for performing the operative settings of the indoor unit 3*b* is connected to the indoor unit 3*b* via a communication wire 8*b*, and an air-conditioning controller 1*c* mainly for performing the operative settings of the indoor unit 3*c* is connected to the indoor unit 3*c* via a communication wire 8*c*. The air-conditioning controllers 1*a* to 1*c* are installed on the wall surface of the room interior. The air-conditioning controllers 1*a* to 1*c* are designed to be supplied with electric power via their respective communication wires 8*a* to 8*c* and capable of ensuring constant electric power.

The user of the air-conditioning apparatus 100 can be provided with support relating to trouble and the like arising during the operation of the air-conditioning apparatus 100, from a contact center in a different location from where the air-conditioning apparatus 100 is set up. Specifically, the user of the air-conditioning apparatus 100 can contact the contact center by phone, over the Internet, or via another communication means when trouble arises, and can receive support from the contact center staff to resolve the trouble.

<Configuration of Air-Conditioning Controller 1>

Figure 3:
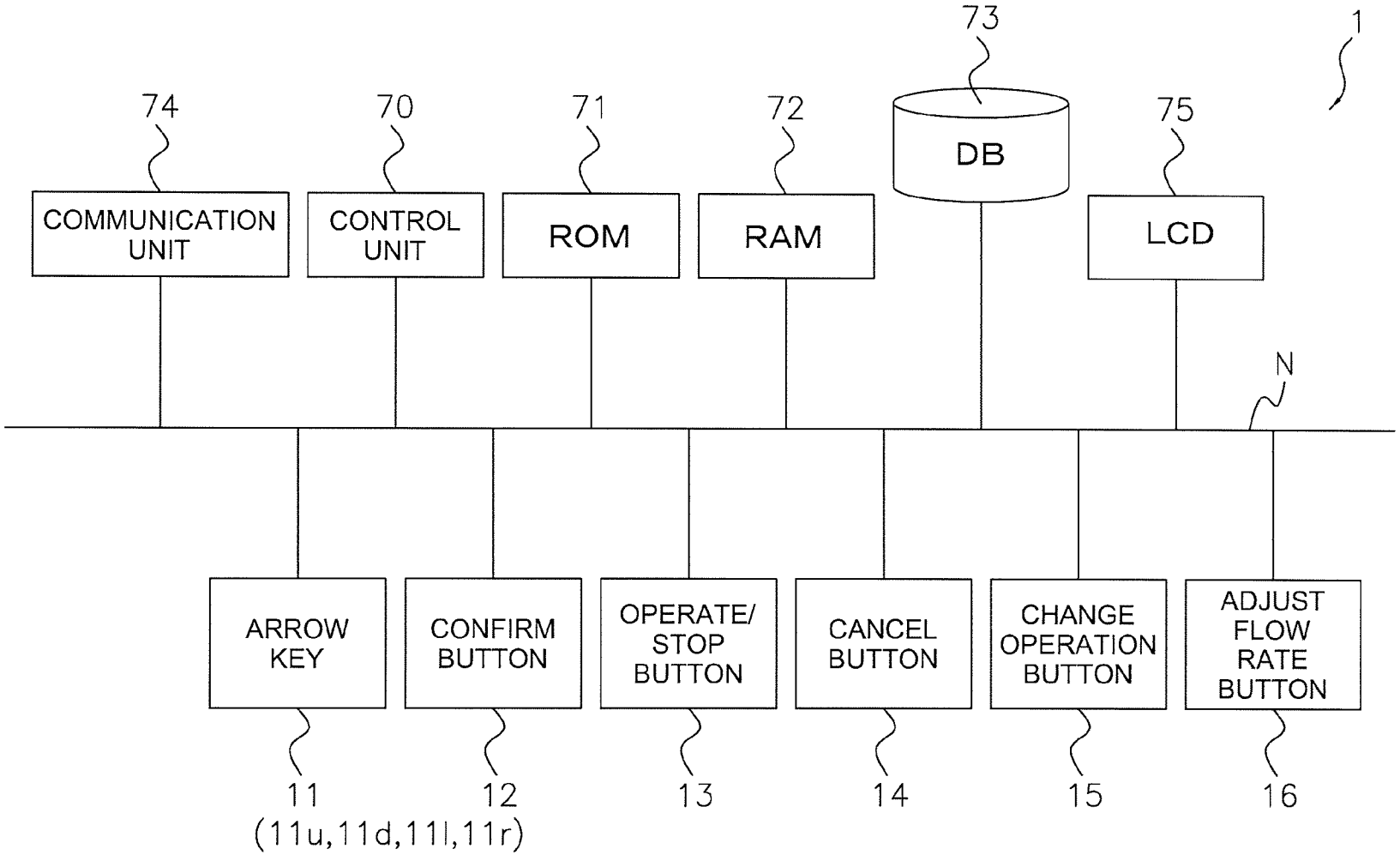
FIG. 3 is a block configuration diagram of the air-conditioning controller.

FIG. 3 shows a function block diagram of an air-conditioning controller 1.

The air-conditioning controller 1 includes a communication unit 74, a control unit 70, a ROM 71, a RAM 72, a database 73, an LCD 75, and various operation buttons 11 to 16, which all communicate with each other via a network N.

The communication unit 74 is connected with an indoor unit 3 via a communication wire 8 described above. The communication unit 74 transmits to the indoor unit 3 information indicating the operative setting inputted by the user to the air-conditioning controller 1, and reads in information relating to the operating state of the air-conditioning apparatus 100 from the air-conditioning apparatus 100.

Figure 4:
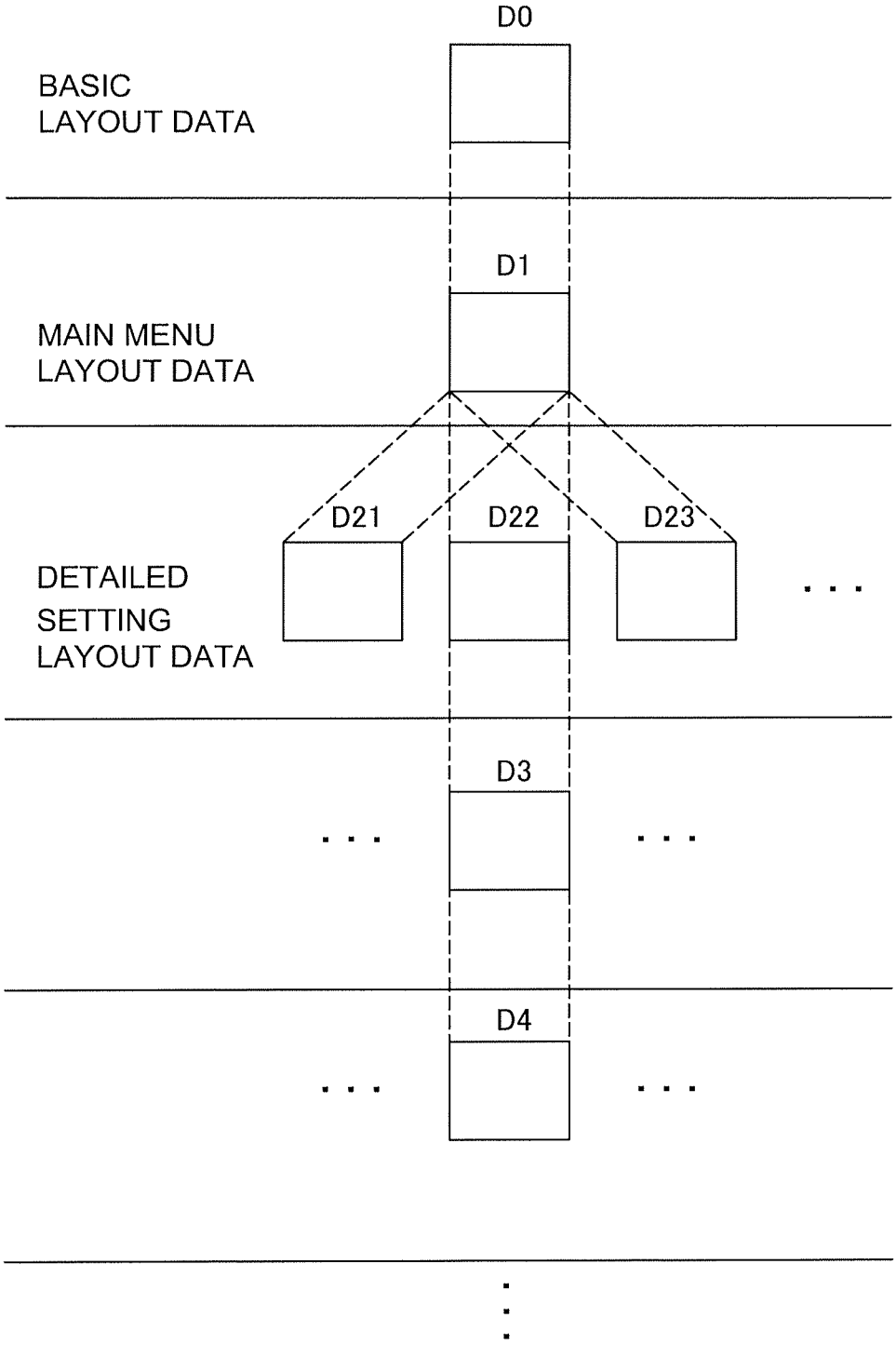
FIG. 4 is a diagram showing a layered structure of screens.

The database 73 stores layout data and the like for forming a screen displayed on the LCD 75. Basic layout data for forming a basic screen D0, main menu layout data for forming a main menu screen D1, detailed setting layout data for forming detailed setting screens D2, and other types of layout data are stored as the layout data. This layout data is hierarchized in the database 73 (see FIG. 4). The basic screen D0 is positioned at the highest layer in hierarchic structure of the screens, and the main menu screen D1 is positioned at a one-level lower layer than the layer at which the basic screen D0 is positioned. There are one basic screen D0 and one main menu screen D1 each. Directly below the main menu screen D1, there are the same number of detailed setting screens D21, D22, D23, . . . as the number of the setting items displayed on the main menu screen D1, including "airflow direction setting", "ventilation", "timer setting", "low energy setting", "useful features", "clock", and the like. The detailed setting screen D21 is an airflow direction setting screen for setting the airflow direction of the indoor unit 3, as is described hereinafter. Some of the plurality of detailed setting screens D21, D22, D23, . . . are linked to detailed setting screens D3, D4, . . . at lower layers.

Figure 5:
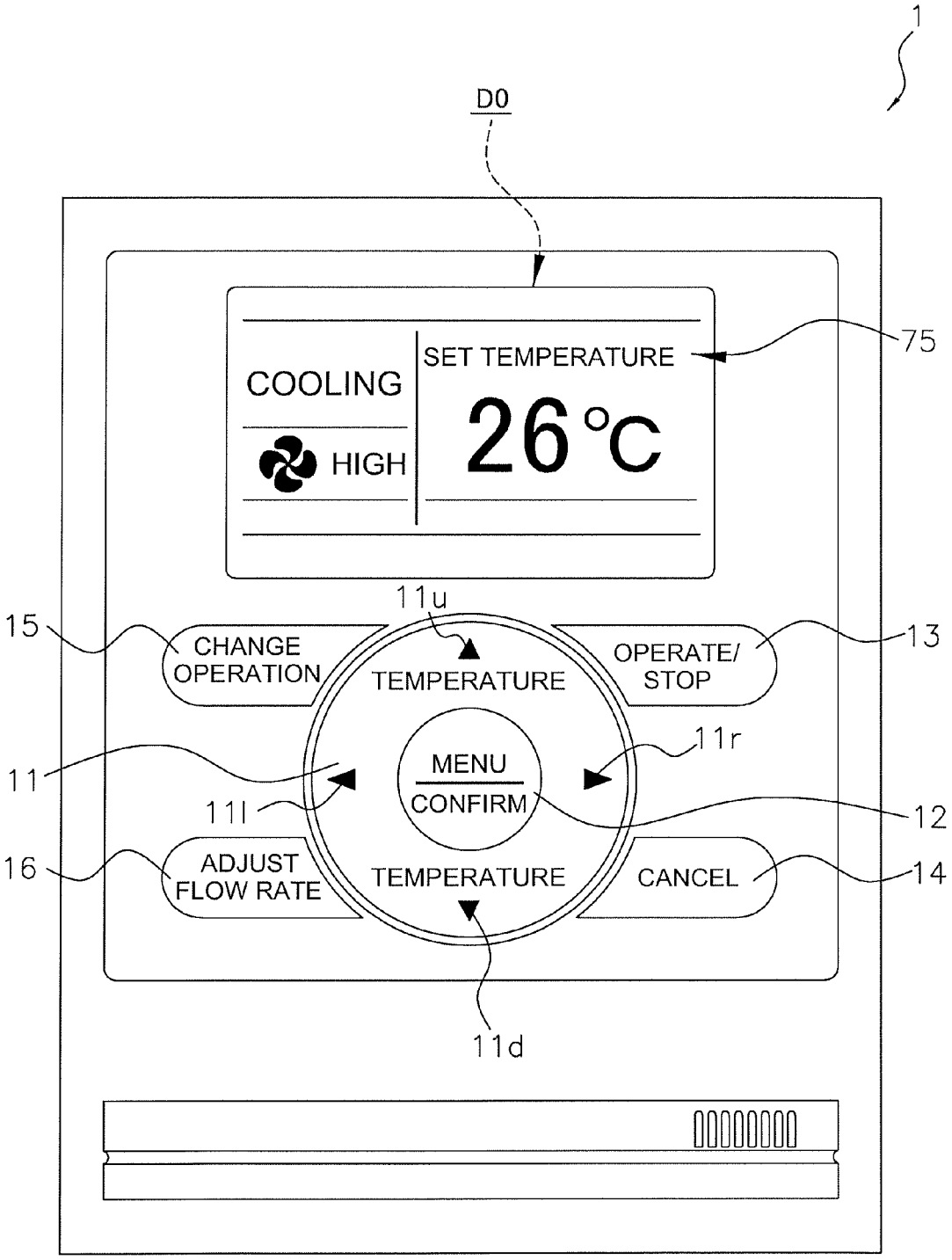
FIG. 5 is a drawing showing the air-conditioning controller in a state of a basic screen being displayed on an LCD.
Figure 6:
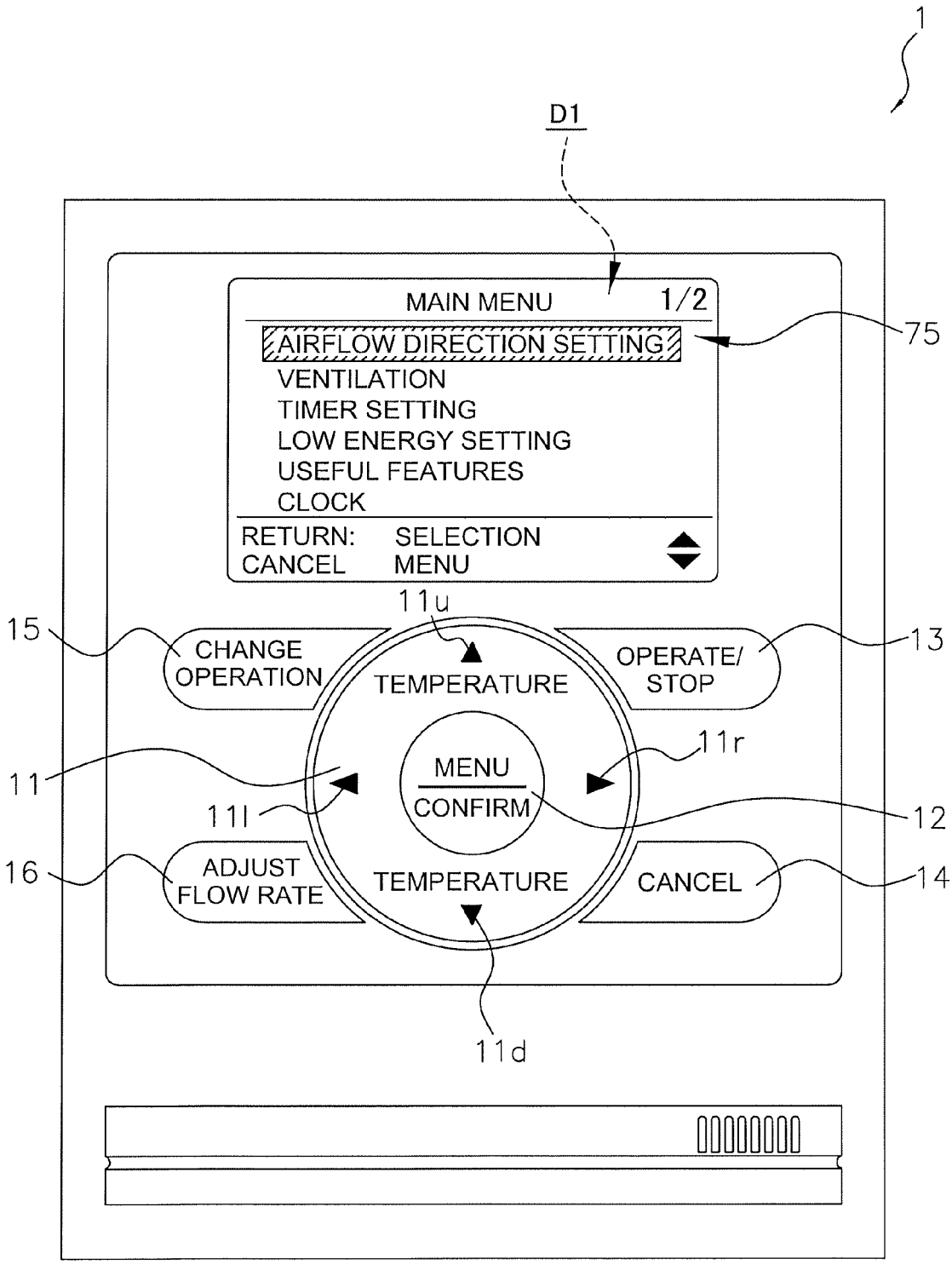
FIG. 6 is a drawing showing the air-conditioning controller in a state of a menu screen being displayed on an LCD.
Figure 7D:
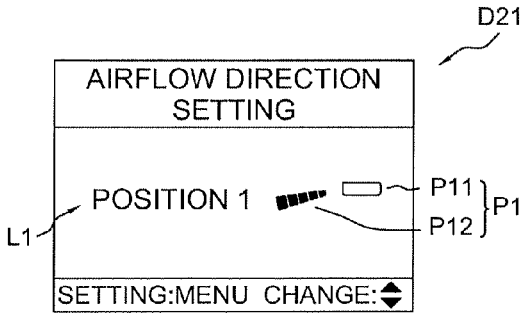
FIG. 7(*a*) is a drawing showing an airflow direction setting screen when "position 4" has been selected.
Figure 7A:
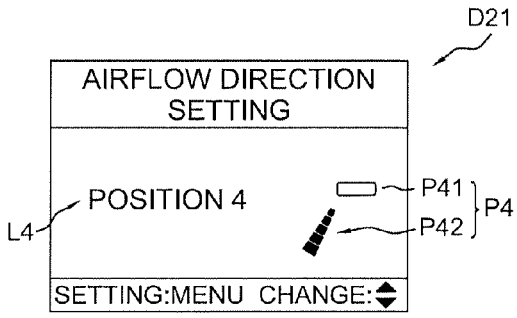
Figure 7E:
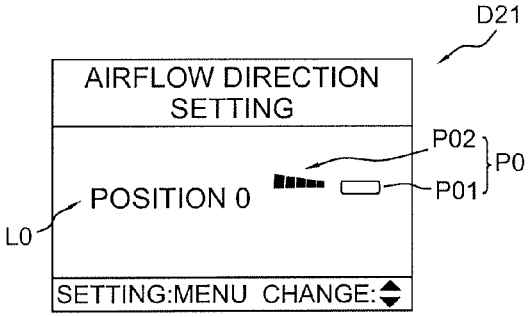
Figure 7B:
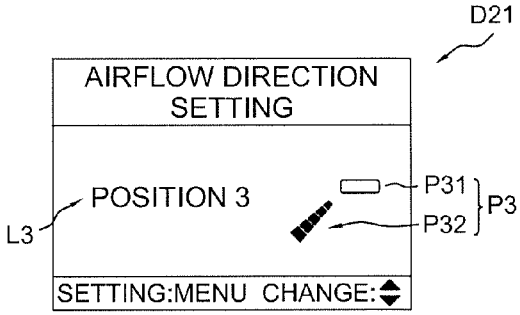
Figure 7F:
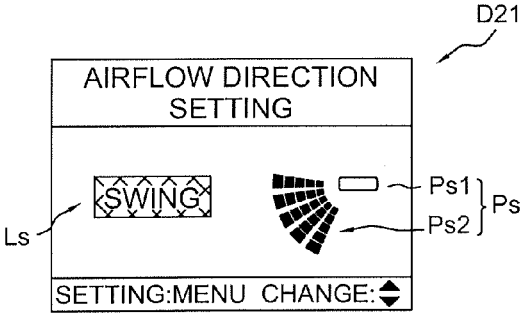
Figure 7C:
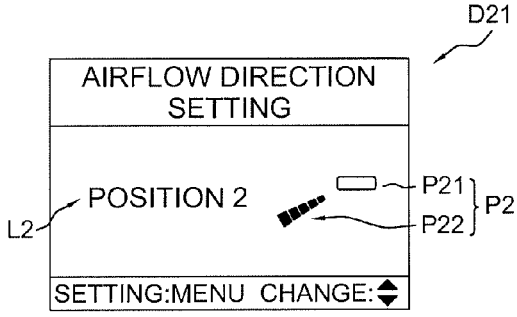
Figure 8D:
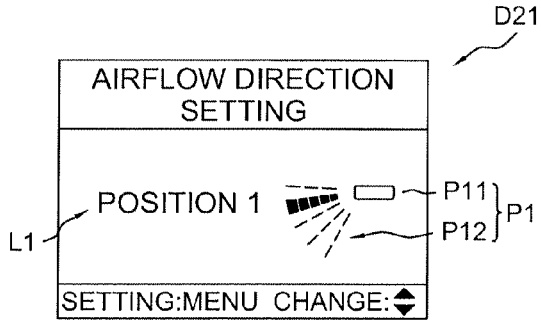
FIG. 8(*a*) is a drawing showing an airflow direction setting screen according to Modification (D) when "position 4" has been selected.
Figure 8A:
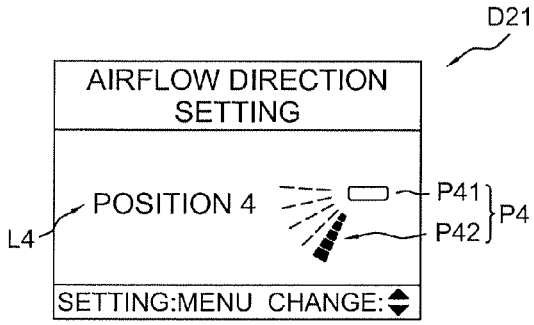
Figure 8E:
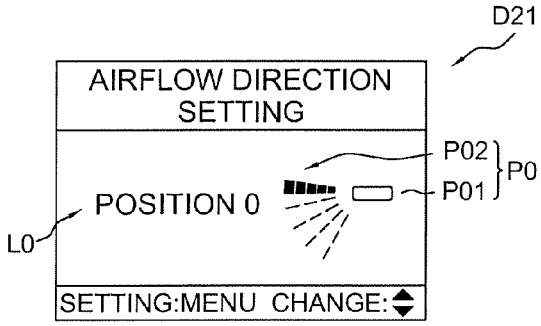
Figure 8B:
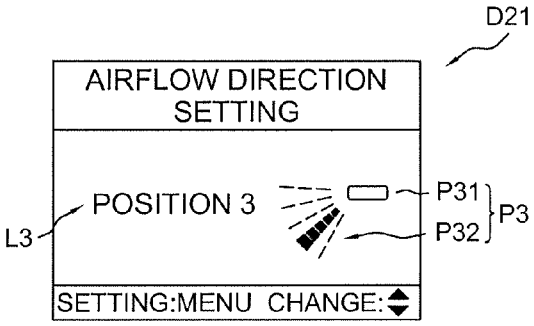
Figure 8F:
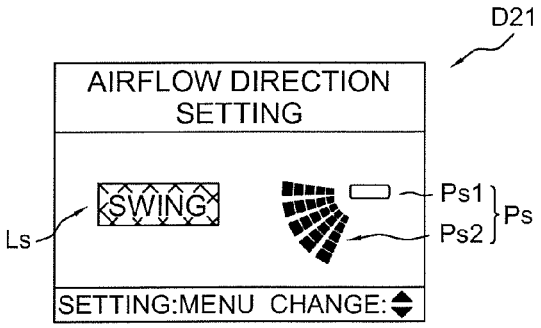
Figure 8C:
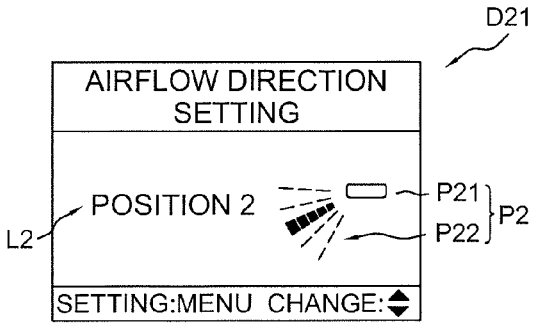
Figure 9D:
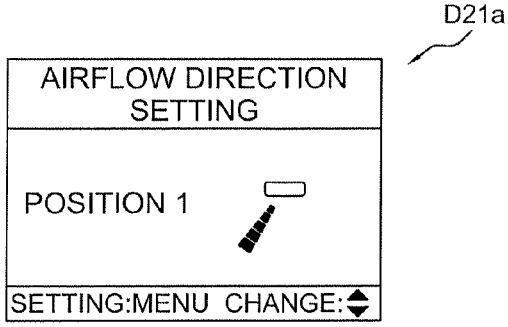
FIG. 9(*a*) is a drawing showing an airflow direction setting screen according to Modification (E) when "position 4" has been selected.
Figure 9A:
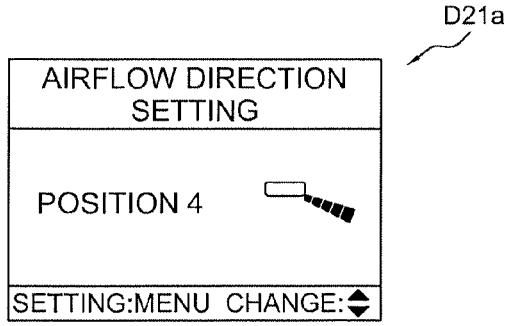
Figure 9E:
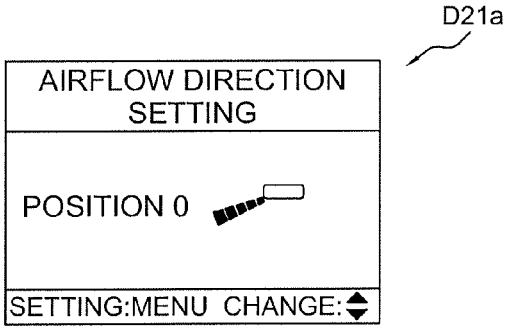
Figure 9B:
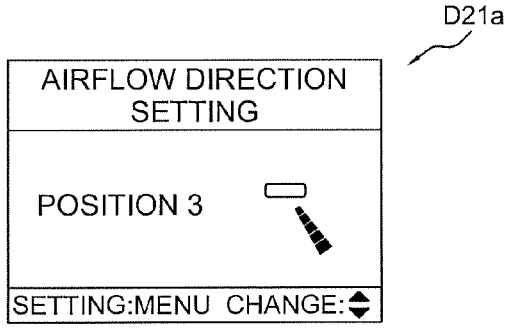
Figure 9F:
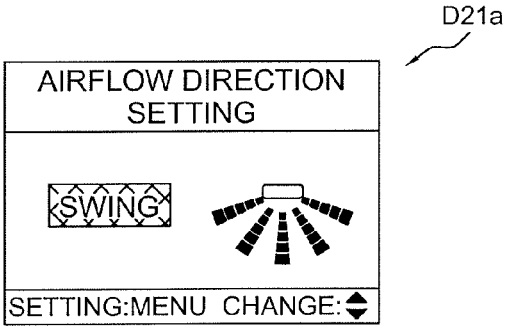
Figure 9C:
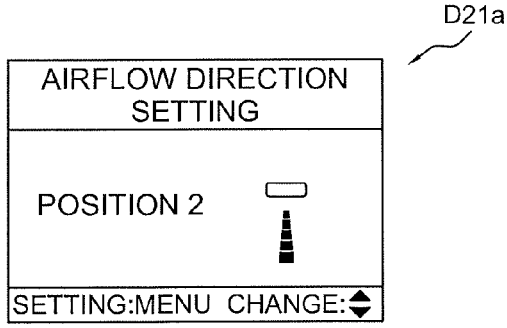

The LCD 75 is a dot matrix type of liquid crystal display unit that is highly flexible to display graphics. Various information such as is shown in FIGS. 5 to 7 is displayed on the LCD 75 by the control unit 70 performing data processing on the basis of data inputted via the operation buttons 11 to 16, data received by the communication unit 74 from the air-conditioning apparatus 100, and other data.

The operation buttons 11 to 16 are composed of an arrow key 11 (11*u*, 11*d*, 11*l*, 11*r*), a confirm button 12, an operate/stop button 13, a cancel button 14, a change operation button 15, and an adjust flow rate button 16; and information inputted via these buttons is processed by the control unit 70.

The arrow key 11 includes an up arrow key 11*u*, a down arrow key 11*d*, a left arrow key 11*l*, and a right arrow key 11*r*. These four keys 11*u* to 11*r* are arranged so as to collectively form a cross. The four keys 11*u* to 11*r* are formed integrally in appearance, and are assigned to the respective areas up, down, left, and right on one donut ring button. The confirm button 12 is a circular button encircled by the donut-shaped arrow key 11. The operate/stop button 13, the cancel button 14, the change operation button 15, and the adjust flow rate button 16 are arranged adjacent to the arrow key 11 and in the upper right side, the lower right side, the upper left side, and the lower left side of the arrow key 11, respectively.

When the operation buttons 11 to 16 are pressed by the user, information indicating as much is sent immediately to the control unit 70. The control unit 70 determines the operative settings desired by the user for the air-conditioning apparatus 100 and controls the air-conditioning apparatus 100 in accordance with these operative settings, while appropriately changing the screen displayed on the LCD 75 on the basis of the information indicating the manner in which the operation buttons 11 to 16 are operated.

More specifically, when the up arrow key 11*u* is pressed, the control unit 70 moves the cursor upward in the LCD 75 or increases numerical value pertaining to the operative setting. The numerical values pertaining to operative settings include a temperature setting value, an airflow rate setting value, and the like. When the down arrow key 11*d* is pressed, the control unit 70 moves the cursor downward in the LCD 75 or reduces the numerical value pertaining to the operative setting. When the right arrow key 11*r* is pressed, the control unit 70 moves the cursor to the right in the LCD 75, or displays on the LCD 75 a more detailed setting screen relating to the currently selected setting item, i.e., a screen one level lower than the currently displayed screen. When the left arrow key 11*l* is pressed, the control unit 70 moves the cursor to the left in the LCD 75, or returns the currently displayed screen on the LCD 75 to one previous screen, i.e., displays on the LCD 75 a screen one level higher than the currently displayed screen.

When the confirm button 12 is pressed, the control unit 70 displays on the LCD 75 a screen one level lower than the currently displayed screen, or ultimately confirms the currently selected operative setting as the operating setting selected by the user.

When the operate/stop button 13 is pressed, the control unit 70 switches between operating and stopping the air-conditioning apparatus 100.

When the cancel button 14 is pressed, the control unit 70 switched the screen currently displayed on the LCD 75 to the basic screen D0, or cancels a currently selected operating setting that has not been confirmed.

When the change operation button 15 is pressed, the control unit 70 switches the operation mode of the air-conditioning apparatus 100 between a cooling operation mode, a heating operation mode, and the like.

When the adjust flow rate button 16 is pressed, the control unit 70 displays an airflow rate setting screen for adjusting the airflow rate of the air-conditioning apparatus 100 directly on the LCD 75 without transitioning through the main menu screen D1.

<Basic Screen D0>

FIG. 5 shows the air-conditioning controller 1 in a state in which the basic screen D0 is displayed on the LCD 75.

Information indicating the currently selected operation mode (cooling), the currently selected set temperature (26° C.), and the currently selected operating speed (high) is displayed on the basic screen D0. In this state, when the up arrow key 11*u* of the arrow key 11 is pressed by the user, the set temperature is set to increase by 1° C.; and when the down arrow key 11*d* of the arrow key 11 is pressed, the set temperature is set to decrease by 1° C. In other words, the up arrow key 11*u* and the down arrow key 11*d* of the arrow key 11 function as direct keys for directly setting the set temperature without transitioning through the main menu screen D1, the detailed setting screens D21, D22, D23, . . . , or other screens.

When the confirm button 12 is pressed in a state in which the basic screen D0 is displayed on the LCD 75, the basic screen D0 displayed on the LCD 75 is changed to the main menu screen D1 one level lower than the basic screen D0.

<Main Menu Screen D1>

FIG. 6 shows the air-conditioning controller 1 in a state in which the main menu screen D1 is displayed on the LCD 75.

Vertically aligned on the main menu screen D1 are menu titles corresponding to various setting items, including "airflow direction setting", "ventilation", "timer setting", "low energy setting", "useful features", "clock" and others.

When the up arrow key 11*u* or down arrow key 11*d* of the arrow key 11 is pressed in a state in which the main menu screen D1 is displayed on the LCD 75, the cursor moves either up or down on the LCD 75. When the user then presses the confirm button 12 or the right arrow key 11*r* after having matched the cursor with the menu title corresponding to the intended setting item (for example, "airflow direction setting"), the LCD 75 displays an airflow direction setting screen D21 for setting the airflow direction setting, which is the setting item indicated by the cursor (i.e., currently selected) when the button 12 or key 11*r* is pressed.

<Airflow Direction Setting Screen D21>

The airflow direction setting screens D21 shown in FIGS. 7(*a*) through 7(*f*) are screens for selecting/setting the airflow direction setting of the indoor unit 3. There are six types of airflow direction settings that can be set for the indoor unit 3: "swing", and "position 0" through "position 4". When the setting is at "position 4", the air from the indoor unit 3 is blown out at a downward slant. As the accompanying numeral decreases from "4" to "0", the air from the indoor unit 3 will be blown out at a more upward incline, and when the setting is at "position 0", the air from the indoor unit 3 is blown out in a substantially horizontal direction. When the setting is at "swing", the air blown out from the indoor unit 3 is swung between the state of "position 0" and the state of "position 4". These six airflow direction settings are managed in turns in the database 73. More specifically, the order of "position 4", "position 3", "position 2", "position 1", "position 0", and "swing" which are ordered so as to have a gradual increase in the amount of upward orientation in the wind blown out from the indoor unit 3, is managed as the forward direction; and the reverse order thereof is managed as the reverse direction.

When the operation buttons 11 to 16 are operated by the user so as to switch the main menu screen D1 displayed on the LCD 75 to the airflow direction setting screen D21, the control unit 70 creates the airflow direction setting screen D21 on the basis of airflow direction setting layout data stored in the database 73 and displays this screen on the LCD 75. More specifically, at this time, the control unit 70 determines the currently selected airflow direction setting on the basis of information stored in a predetermined storage area in the database 73, and reads from the database 73 data pertaining to images and characters corresponding to the airflow direction setting determined to be currently selected. Information pertaining to images and characters corresponding one-to-one to the airflow direction settings are stored in advance in the database 73. As a default value when the air-conditioning controller 1 is shipped, information indicating "swing" is also stored in the aforementioned storage area provided in the database 73 in order to store information indicating the currently selected airflow direction setting. The control unit 70 then creates the airflow direction setting screen D21 on the basis of the data pertaining to the read images and characters and also the airflow direction setting layout data read from the database 73.

When the up arrow key 11*u* or the down arrow key 11*d* of the arrow key 11 is pressed by the user while the airflow direction setting screen D21 is displayed on the LCD 75, information indicating as much is sent immediately to the control unit 70. Every time the control unit 70 determines that the up arrow key 11*u* has been pressed, the control unit 70 switches the currently selected airflow direction setting to the next airflow direction setting in the forward direction, in accordance with the order of airflow direction settings managed in the database 73. Every time the control unit 70 determines that the down arrow key 11*d* has been pressed, the control unit 70 switches the currently selected airflow direction setting to the next airflow direction setting in the reverse direction, in accordance with the order of airflow direction settings managed in the database 73. In other words, when the up arrow key 11*u* is pressed once in a state of "position 3" having been selected, for example, the airflow direction setting switches to "position 2" and when the down arrow key 11*d* is pressed once, the airflow direction setting switches to "position 4". The airflow direction setting does not switch in cases in which the up arrow key 11*u* is pressed in a state of "swing" having been selected or in cases in which the down arrow key 11*d* is pressed in a state of "position 4" having been selected.

In other words, the control unit 70 determines the airflow direction setting currently selected by the user every time the up arrow key 11*u* or the down arrow key 11*d* is pressed. When the control unit 70 recognizes that the airflow direction setting has been switched, the control unit 70 notifies the air-conditioning apparatus 100 of the switched airflow direction setting. Furthermore, the control unit 70 rewrites the information in the aforementioned storage area as information indicating the switched airflow direction setting, the storage area being provided in the database 73 in order to store information indicating the currently selected airflow direction setting. Furthermore, the control unit 70 switches the airflow direction setting screen D21 on the LCD 75 to a screen corresponding to the airflow direction setting determined to be currently selected.

In cases in which "position 0" has been selected as shown in FIG. 7(*e*), the characters L0 reading as "position 0" are displayed on the left side of the airflow direction setting screen D21, and at the same time, the image P0 schematically depicting the state of "position 0" is displayed on the right side of the airflow direction setting screen D21. The image P0 schematically depicting the state of "position 0" is configured from a first image P01 schematically depicting the indoor unit 3, and a second image P02 schematically depicting the air blown out from the indoor unit 3. The second image P02 in the state of "position 0" in which air from the indoor unit 3 is blown out substantially horizontally is shown as an image of a line shape extending horizontally from around the image of a substantially rectangular shape (first image P01) representing the indoor unit 3.

In cases in which any one of the positions "position 1" through "position 4" is selected, the respective characters L1 through L4 are displayed on the left side of the airflow direction setting screen D21, and at the same time, the respective images P1 through P4 are displayed on the right side of the airflow direction setting screen D21, as shown in FIGS. 7(*a*) through 7(*d*). The characters L1 through L4 are respectively characters reading as "position 1" through "position 4," and the images P1 through P4 are respectively images schematically depicting the state of "position 1" through the state of "position 4." The images P1 through P4 are respectively configured from first images P11 through P41 schematically depicting the indoor unit 3, and second images P12 through P42 schematically depicting the air blown out from the indoor unit 3.

In cases in which "swing" is selected, the characters Ls reading as "swing" are displayed on the left side of the airflow direction setting screen D21, and at the same time, the image Ps schematically depicting the "swing" state is displayed on the right side of the same screen D21, as shown in FIG. 7(*f*). The image Ps schematically depicting the "swing" state is configured from a first image Ps1 schematically depicting the indoor unit 3, and a second image Ps2 schematically depicting the swinging range of the air blown out from the indoor unit 3.

The first images P01 through P41 and Ps1 corresponding to the respective airflow direction settings share the same shape, and also share the same position on the airflow direction setting screen D21, as shown in FIGS. 7(*a*) through 7(*f*). The second images P02 through P42 corresponding to the respective positions "position 0" through "position 4" are the same images of a line shape, but their positions on the airflow direction setting screen D21 are different. More specifically, as the positions are switched one by one from "position 0" to "position 4", the second images P02 through P42 having line shapes representing the air blown out from the indoor unit 3 gradually point farther downward.

The second image Ps2 corresponding to "swing" is an image in which the second image P02 corresponding to "position 0" through to the second image P42 corresponding to "position 4" are simultaneously displayed all together. The user can thereby instantly perceive that "swing" is currently selected, unlike a conventional air-conditioning controller in which the swing setting is expressed by a moving image in which the schematics depicting air blown out in various directions are switched in sequence.

<Characteristics of Air-Conditioning Controller 1>

(1)

On the LCD 75 of the air-conditioning controller 1, any one of the images P0 through P4 and Ps, and any one of the characters L0 through L4 and Ls corresponding to the airflow direction setting currently selected by the user are simultaneously displayed. Therefore, the user can perceptively recognize the currently selected airflow direction setting by referring to the images P0 through P4 and Ps, and can also easily and accurately recognize their own selected airflow direction setting by referring to the characters L0 through L4 and Ls. Other people are also easily informed by the user of the user's currently selected airflow direction setting by the display of characters L0 through L4 and Ls. Therefore, in cases in which the user has contacted the contact center when an abnormality has occurred, for example, contact center staff is easily informed of whichever airflow direction setting is currently selected.

(2)

Conventional air-conditioning controllers include those in which schematic images depicting the various airflow direction settings are displayed in sequence on the screen by animation, and the airflow direction setting is selected by pressing the predetermined button while the image corresponding to the user's desired airflow direction setting is being displayed. With such conventional air-conditioning controllers, it has been difficult for users to select their personally desired airflow direction settings.

With the air-conditioning controller 1 according to the present invention, however, users can select their own desired airflow direction setting from among a plurality of selectable airflow direction settings in the indoor unit 3 while pressing the up arrow key 11*u* and the down arrow key 11*d*, and the aforementioned conventional problems are resolved.

(3)

In the embodiment described above, when the user presses the up arrow key flu when setting the airflow direction, the setting is changed so that the air from the indoor unit 3 is oriented higher up, and when the user presses the down arrow key 11*d*, the setting is changed so that the air from the indoor unit 3 is oriented farther down. The user thereby easily envisions how the airflow direction setting will change when the up arrow key 11*u* and down arrow key 11*d* are pressed when adjusting the airflow direction of the indoor unit 3.

(4)

In the embodiment described above, the characters L0 through L4 displayed on the airflow direction setting screen D21 include the numerals "0" through "4", respectively. Thus, the currently selected airflow direction setting is displayed in a straightforward manner by numerals, whereby the user can accurately recognize the currently selected airflow direction setting.

<Modifications>

(A)

In the embodiment described above, the currently selected airflow direction setting does not change in cases in which the up arrow key 11*u* is pressed while "swing" has been selected and in cases in which the down arrow key 11*d* is pressed while "position 4" has been selected. However, in another embodiment, the currently selected airflow direction setting may switch from "swing" to "position 4" in cases in which the up arrow key 11*u* is pressed while "swing" has been selected, and the currently selected airflow direction setting may switch from "position 4" to "swing" in cases in which the down arrow key 11*d* is pressed while "position 4" has been selected.

(B)

In the embodiment described above, the airflow direction setting of the indoor unit 3 is changed by pressing the up arrow key 11*u* or the down arrow key 11*d* when the airflow direction setting screen D21 is displayed, and this change is confirmed as is. However, the change in the airflow direction setting of the indoor unit 3 may also be designed not to be confirmed unless the confirm button 12 is pressed after the up arrow key 11*u* or down arrow key 11*d* has been pressed at least once. In this case, rather than determining the currently selected airflow direction setting every time the up arrow key 11*u* or down arrow key 11*d* is pressed and sending information indicating the airflow direction setting to the air-conditioning apparatus 100, the control unit 70 may be designed to determine the currently selected airflow direction setting for the first time after the pressing of the confirm button 12, and to send information indicating the airflow direction setting to the air-conditioning apparatus 100.

(C)

The characters L0 through L4 and Ls displayed on the airflow direction setting screen D21 may be characters that do not contain numerals, such as "up", "mid", and "down". The characters may also be composed of numerals alone.

(D)

In the embodiment described above, the second images P02 through P42 corresponding to "position 0" through "position 4" and not "swing" are configured from one line-shaped image each. However, the second images P02 through P42 may be images formed by using highlighting to display only the schematic image of air blown out from the indoor unit 3 in the currently selected airflow direction setting, and at the same time displaying thin schematic images of air blown out from the indoor unit 3 in the airflow direction settings not currently selected, as shown in FIGS. 8(*a*) through 8(*f*).

(E)

In the embodiment described above, the indoor unit 3 is a ceiling-suspended design, but may also be a floor-standing design or another design.

FIGS. 9(*a*) through 9(*f*) show airflow direction setting screens D21*a* displayed on the LCD 75 of the air-conditioning controller 1 in a case in which the indoor unit 3 is a floor-standing design. The selectable airflow direction settings for this floor-standing indoor unit 3 also have six settings: "swing" and "position 0" through "position 4", similar to the ceiling-suspended design. The schematic images of the indoor unit 3 and the air blown out from the indoor unit 3 on this airflow direction setting screen D21*a* differ from those corresponding to the ceiling-suspended design.

In this case, the air-conditioning controller 1 may be designed so that information pertaining to the indoor unit 3 indicating whether it is a ceiling-suspended design or a floor-standing design is automatically acquired from the indoor unit 3 via the communication wire 8, and an airflow direction setting screen D21*a* is created based on the acquired information. The information pertaining to the design of the indoor unit 3 may otherwise be acquired by the user's manual input via the operation buttons 11 to 16. In other words, the air-conditioning controller 1 can be adapted to indoor units 3 of many various designs.

In the airflow direction setting screen D21*a* corresponding to a floor-standing indoor unit 3 as shown in FIGS. 9(*a*) through 9(*f*), the schematic image of air blown out from the indoor unit 3 changes so as to move to the left and right whenever the airflow direction setting is switched. Therefore, in this modification, the airflow direction setting may be switched by pressing the left arrow key 11*l* and the right arrow key 11*r*, rather than pressing the up arrow key 11*u* and the down arrow key 11*d* while the airflow direction setting screen D21*a* corresponding to the floor-standing indoor unit 3 is being displayed.

(F)

The air-conditioning apparatus 100 may be designed so that the air-conditioning apparatus 100 is connected to a remote management server in a remote location via the internet, phone lines, or the like; various data pertaining to the air-conditioning apparatus 100 can be sent to the remote management server; and needed data can be received from the remote management server.

(G)

The air-conditioning controller 1 may be a remote controller rather than being mounted on a wall surface.

INDUSTRIAL APPLICABILITY

The present invention has the effect of making it possible to improve the operability of an air-conditioning controller with respect to the airflow direction settings of an air-conditioning apparatus, and the present invention is useful as an air-conditioning controller for receiving operation input to an air-conditioning apparatus in which a plurality of airflow direction settings can be selected.

What is claimed is:

1. An air-conditioning controller configured to receive an operation input for an air-conditioning apparatus capable of being set to a plurality of airflow direction settings, the air-conditioning controller comprising:

a switching button for switching between the airflow direction settings including constant airflow direction settings, each of the constant airflow direction settings setting an airflow direction of the air-conditioning apparatus to a constant direction which is distinct for each of the constant airflow direction settings, the constant airflow direction settings having a prestored order for changing between the constant airflow direction settings;

a determination unit configured to determine a currently selected airflow direction setting based on an operation input inputted via the switching button; and a display unit configured to simultaneously display an image corresponding to the currently selected airflow direction setting and an alphanumeric character corresponding to the currently selected airflow direction setting, the image and the alphanumeric character each corresponding to the currently selected airflow direction setting in a one-to-one correspondence, a number of the alphanumeric character on the display unit changing sequentially according to the prestored order in response to the currently selected airflow direction setting being switched among the constant airflow direction settings in a first direction of the prestored order corresponding to a first direction of change of the airflow direction.

2. The air-conditioning controller according to claim 1, wherein the switching button includes a first directional button corresponding to the first direction of the change of the airflow direction and a second directional button corresponding to a second direction of the change of the airflow direction opposite the first direction.

3. The air-conditioning controller according to claim 2, wherein the currently selected airflow direction setting switches in a first sequence of the prestored order every time the first directional button is pressed, and the currently selected airflow direction setting switches in a second sequence of the prestored order opposite the first sequence every time the second directional button is pressed.

4. The air-conditioning controller according to claim 3, wherein the first sequence is a sequence whereby the airflow direction settings are arranged from smallest to greatest relative to the first direction of the prestored order.

5. The air-conditioning controller according to claim 4, wherein the first direction of the change of the airflow direction is an upward direction.

6. The air-conditioning controller according to claim 2, wherein the first direction of the change of the airflow direction is an upward direction.

7. The air-conditioning controller according to claim 1, wherein the images corresponding to the airflow direction settings include first images schematically depicting the air-conditioning apparatus and second images schematically depicting the air blown out from the air-conditioning apparatus.

8. The air-conditioning controller according to claim 7, wherein the first images included in the images corresponding to the respective airflow direction settings are mutually shared; and the second images included in the images corresponding to the respective airflow direction settings are mutually different.

9. The air-conditioning controller according to claim 8, wherein a swing setting is included in the airflow direction settings; and the second image included in the image corresponding to the swing setting is an image schematically and simultaneously depicting air blown out in various directions from the air-conditioning apparatus.

10. The air-conditioning controller according to claim 9, wherein the image schematically and simultaneously depicting air blown out in various directions from the air-conditioning apparatus simultaneously depicts all possible directions in the swing setting.

11. The air-conditioning controller according to claim 1, wherein the image displayed by the display unit includes a first image portion corresponding to the currently selected airflow direction setting and a second image portion corresponding to all airflow direction settings which are not currently selected, the first image portion being different from the second image portion.

* * * * *

UNITED STATES PATENT AND TRADEMARK OFFICE

CERTIFICATE OF CORRECTION

PATENT NO. : 8,655,489 B2
APPLICATION NO. : 12/596848
DATED : February 18, 2014
INVENTOR(S) : Kaya Horiuchi et al.

It is certified that error appears in the above-identified patent and that said Letters Patent is hereby corrected as shown below:

TITLE PAGE:

Item (56) References Cited

FOREIGN PATENT DOCUMENTS
Change "2007-15527" to --2007-155271--

Signed and Sealed this
Sixth Day of January, 2015

Michelle K. Lee

Michelle K. Lee
*Deputy Director of the United States Patent and Trademark Office*